United States Patent [19]

Nakayama et al.

[11] 4,244,679

[45] Jan. 13, 1981

[54] SWASH-PLATE-TYPE COMPRESSOR FOR AIR-CONDITIONING VEHICLES

[75] Inventors: Shozo Nakayama; Kimio Kato; Takamitu Mukai; Tomoo Fujii; Hiroya Kono, all of Kariya; Tatsuhiko Fukuoka, Toyota; Eizi Asada, Okazaki; Kenichiro Futamura, Toyota, all of Japan

[73] Assignees: Kabushiki Kaisha Toyoda Jidoshokki Seisakusho, Kariya; Taiho Kogyo Kabushiki Kaisha, Toyota, both of Japan

[21] Appl. No.: 960,775

[22] Filed: Nov. 15, 1978

[30] Foreign Application Priority Data

Jul. 31, 1978 [JP] Japan ..... 53-93396

[51] Int. Cl.[3] ..... F04B 1/14; C22C 9/00; F01B 3/00

[52] U.S. Cl. ..... 417/269; 75/154; 75/160; 75/161; 75/163; 92/71; 308/3 C

[58] Field of Search ..... 75/153, 154, 160, 161, 75/163, 164; 308/3 C, DIG.8; 417/269; 92/71

[56] References Cited

U.S. PATENT DOCUMENTS

| | | | |
|---|---|---|---|
| 1,840,921 | 1/1932 | Spence | 75/161 |
| 1,895,261 | 1/1933 | Herschman et al. | 75/163 |
| 2,018,417 | 10/1935 | Peyinghaus | 75/156 |
| 2,040,053 | 5/1936 | Lytle | 75/156 |
| 2,062,448 | 12/1936 | Deitz, Jr. et al. | 75/161 |
| 2,137,284 | 11/1938 | Hensel et al. | 75/161 |
| 2,797,300 | 6/1957 | Hawthorne | 75/164 |
| 3,017,268 | 1/1962 | Saarivirta | 75/164 |
| 3,801,227 | 4/1974 | Nakayama | 417/269 |
| 3,869,259 | 3/1975 | Lindsey | 75/163 |
| 3,928,028 | 12/1975 | Yarwood | 75/154 |
| 4,037,522 | 7/1977 | Inoshita et al. | 92/71 |
| 4,090,430 | 5/1978 | Matsumoto et al. | 92/71 |

FOREIGN PATENT DOCUMENTS

| | | | |
|---|---|---|---|
| 668539 | 8/1963 | Canada | 75/160 |
| 1278109 | 9/1968 | Fed. Rep. of Germany | 75/161 |
| 44-28789 | 11/1969 | Japan | 75/160 |
| 51-2414 | 1/1976 | Japan | 75/157.5 |
| 377382 | 6/1973 | U.S.S.R. | 75/161 |
| 418545 | 8/1974 | U.S.S.R. | 75/156 |

*Primary Examiner*—L. Dewayne Rutledge
*Assistant Examiner*—Peter K. Skiff
*Attorney, Agent, or Firm*—Burgess, Ryan and Wayne

[57] ABSTRACT

Shoes for operatively connecting a swash-plate with the compression pistons of a swash-plate type compressor are made from a novel Cu-based alloy. Improved shoes are characterized by a combination of high heat conductivity and excellent wear resistance properties particularly when subjected to a lubricating condition so severe that no lubricating oil is supplied to the surface of the shoes at the initial period of the compressor operation. Phosphorus and elements of C group (Pb and/or Sn), as well as elements of A group (Mn and Si) and/or B group (the IVb and VIb groups of the periodic table), are added in predetermined amounts to the Cu-based alloy, so that the properties mentioned above are simultaneously obtained. The compressor according to the present invention can be reliably employed, without the occurrence of seizure over a long operational period for air-conditioning vehicles, in which the sliding condition of the shoes is drastically varied with the rotation of the engine.

24 Claims, 4 Drawing Figures

SWASH-PLATE-TYPE COMPRESSOR FOR AIR-CONDITIONING VEHICLES

The present invention relates to a compressor, and particularly to a swash-plate type compressor for air-conditioning vehicles.

U.S. Pat. No. 3,955,899 issued to Nakayama et al discloses a swash-plate type compressor, in which the swash plate is secured to and rotated with a drive shaft, the rotating movement of which shaft is converted to a reciprocal movement via shoes slidably engaged with the swash plate and via ball bearings for slidably pressing the shoes against the swash plate. The swash-plate type compressor disclosed in the patent mentioned above eliminates the necessity of an oil pump for lubricating the movable parts of the compressor, because, according to the recent tendency to decrease the weight of the vehicle, all compressors utilized for air-conditioning vehicles are required to have a compact structure and a light weight. A small amount of lubricating oil supplied to the slidable arrangements, for example, between the shoes and the ball bearings of the swash-plate type compressor disclosed in the U.S. patent mentioned above, is supplied in a gaseous state after being mixed with a refrigerant gas. The lubricating system employed in the swash-plate type compressor, without the presence of an oil pump, gasifies the lubricating oil and effectively circulates the oil through the slidable arrangements of the compressor.

Materials such as (A) alloy steels for structural uses, for example, (1) nickel-chromium steel, (2) nickel-chromium-molybdenum steel and (3) chromium-molybdenum steel, and (B) a nodular graphite cast iron, have heretofore been used for forming a swash plate so as to provide the swash plate with resistance against high surface pressure and against impact loads, as well as against poor lubricating conditions. In such cases, the surface of the swash plate was quenched so as to enhance the wear resistance and the fatigue strength thereof. Since the ball bearings must mainly undertake a high load, a high-carbon chromium steel and the like were used for constructing the ball bearings. With regard to the shoes, materials such as Alusil alloy, phosphorus bronze, copper-lead-tin alloy, brass, high strength brass alloy, bronze alloy, aluminum bronze, Babbitt metal and oil-impregnated bearing alloy were considered in the art to be suitable materials for constructing the shoes.

However, when the swash-plate type compressor is employed for air-conditioning vehicles, the operational conditions of the compressor become considerably more severe, because the drive source of the compressor is an internal combustion engine, i.e., a gasoline engine or a Diesel engine, and furthermore because the compressor, which is compact in structure and light in weight, is rotated at almost the same rotational speed as that of the internal combustion engine. Accordingly, the swash-plate type compressor is subjected to a rotational rate of 500 rpm when the internal combustion engine is idling, and to a rotational rate of 6000 rpm during sudden acceleration or during high speed travel.

In addition, frictional wear of the sliding elements of the compressor is liable to be induced because the oil pump mentioned above is eliminated from the compressor and also because the amount of the lubricating oil used therein is decreased in order to increase the efficiency of the compressor mentioned above. In more detail, the service life of the slidable arrangement between the swash plate and the shoes is most critically influenced by the lubricating condition therebetween, particularly by the amount of lubricating oil. In addition, since the sliding movement of the swash plate with respect to the shoes is performed under a thrust force, the sliding surfaces are constantly maintained under boundary lubrication and thus make solid contact with each other, i.e., without an intermediate layer of lubricating oil. It is, therefore, difficult to obtain a sufficient lubricating effect for the slidable arrangement between the swash plate and the shoes, even when the entire amount of lubricating oil supplied to the compressor is increased. In addition to the thrust sliding action, the lubricating oil cannot be supplied to the sliding surfaces of the swash plate and the shoes, because the variable rotational speed of the swash-plate compressor prevents it, and this condition will prevail for so long as the compressor is employed for air-conditioning vehicles. For example, during a period of several tens of seconds or even a period of a few minutes, after the starting of the compressor, the swash plate slides with respect to the shoes, but it is not lubricated at all by oil; consequently, a solid contact between the shoes and the swash plate is disadvantageously carried out during the initial period of the compressor operation. Accordingly, a detrimental sliding condition caused by the absence of a lubricating oil supply will in turn cause the occurrence of seizure of the swash plate by the shoes, which seizure is most frequently encountered during accidents in the operation of the swash-plate type compressor. Even if such seizure is not brought about directly by the sliding condition wherein lubricating oil is not supplied, abrasion caused under the above-mentioned detrimental condition may become a serious defect which afterwards leads to the occurrence of seizure of the swash-plate by the shoes. In addition, due to recent temperature increases in engine rooms caused by the addition thereinto of various vehicle parts, such as devices for purification of exhaust gas for decreasing fuel consumption and the like, lubricating oil used in engine rooms is thus disadvantageously influenced to an appreciable extent by such elevated temperatures.

Since some of the present Inventors found that none of the above-mentioned materials, such as Alusil alloy, was satisfactory for forming shoes to be used under severe, operational conditions of swash-plate type compressors, the Assignee, to whom the invention of the present Inventors was assigned, filed Japanese Patent Application No. 49-109856 (corresponding to U.S. Pat. No. 4,037,522), in which only a bimetal consisting of a steel base and an alloy powder of copper-lead-tin sintered onto the base is disclosed as an applicable material for ensuring the long service life of the shoes. However, it has now been discovered by the present Inventors that this bimetal is not sufficiently suited for the swash-plate type compressor, which is required to be smaller in size and more effective than before, because seizure of the swash plate by the shoes occurs quite visibly in this compressor.

It is, therefore, the main object of the present invention to provide a swash-plate type compressor, which possesses a higher degree of efficiency and a longer service life than the conventional compressors.

It is another object of the present invention to provide shoes for the swash-plate type compressor which are particularly adapted to air-conditioned vehicles, so that such shoes can be stable and resist the alternating sliding and thrust pressures and also resist effectively under sliding conditions wherein a minor amount of lubricating oil is circulated in the state of a gaseous mixture with the refrigerant gas within the compressor and wherein a minor amount of lubricating mixture is not supplied at all to the sliding arrangement of the shoes and the swash plate during a period of a few seconds or even a few minutes after the starting of the compressor.

In accordance with the objects of the present invention, there is provided a swash-plate type compressor, comprising a cylinder block, a swash plate rotatably mounted in a cylinder block and supported by a rotating drive shaft, at least one piston slidably retained within the cylinder block, and shoes mounted on the swash plate and retained by ball bearings, which ball bearings are operably connected with the piston, wherein the swash-plate reciprocates, by its rotation, at least one piston via the shoes and ball bearings, characterized in that the shoes consist of any one of the following compositions.

A. A copper-based alloy, which is hereinafter referred to as an A group alloy with Pb, consists essentially of from 0.5 to 8% of manganese, from 0.1 to 4% of silicon, from 0.5 to 15% of lead and not more than 1.5% of phosphorus, the balance being copper.

B. A copper-based alloy, which is hereinafter referred to as an A group alloy with Sn, consists essentially of from 0.5 to 8% of manganese, from 0.1 to 4% of silicon and less than 5% (not including zero%) of tin, the balance being copper.

C. A copper-based alloy which is hereinafter referred to as an A group alloy with Pb and Sn, consists essentially of from 0.5 to 8% of manganese, from 0.1 to 4% of silicon, from 0.5 to 15% of lead, less than 5% (not including zero%) of tin, and not more than 1.5% of phosphorus, the balance being copper.

D. A copper-based alloy, which is hereinafter referred to as a B group alloy with Pb, consists essentially of not more than 1% in total of at least one element selected from the IVb group and the VIb group of the periodic table, from 0.5 to 15% of lead, and not more than 1.5% of phosphorus, the balance being copper.

E. A copper-based alloy, which is hereinafter referred to as a B group alloy with Sn, consists essentially of not more than 1% in total of at least one element selected from the IVb group and the VIb group of the periodic table, less than 5% (not including zero%) of tin, and not more than 1.5% of phosphorus, the balance being copper.

F. A copper-based alloy, which is hereinafter referred to as a B group alloy with Pb and Sn, consists essentially of not more than 1% in total of at least one element selected from the IVb group and the VIb group of the periodic table, from 0.5 to 15% of lead, less than 5% (not including zero%) of tin, and not more than 1.5% of phosphorus, the balance being copper.

G. A copper-based alloy, which is hereinafter referred to as an A-B group alloy with Pb, consists essentially of from 0.5 to 8% of manganese, from 0.1 to 4% of silicon, not more than 1% in total of at least one element selected from the IVb group and the VIb group of the periodic table, from 0.5 to 15% of lead, and not more than 1.5% of phosphorus, the balance being copper.

H. A copper-based alloy, which is hereinafter referred to as an A-B group alloy with Sn, consists essentially of from 0.5 to 8% of manganese, from 0.1 to 4% of silicon, not more than 1% in total of at least one element selected from the IVb group and the VIb group of the periodic table, less than 5% (not including zero%) of tin, and not more than 1.5% of phosphorus, the balance being copper.

I. A copper-based alloy, which is hereinafter referred to as an A-B group alloy with Pb and Sn, consists essentially of from 0.5 to 8% manganese, from 0.1 to 4% of silicon, not more than 1% in total of at least one element selected from the IVb group and the VIb group of the periodic table, from 0.5 to 15% of lead, less than 5% (not including zero%) of tin, and not more than 1.5% of phosphorus, the balance being copper.

The percentages used in the specification are all by weight.

The preferred compositions of the copper based alloys according to the present invention are as follows.

A'. A copper-based alloy consists essentially of from 1 to 5% of manganese, from 0.3 to 2% of silicon, from 2.5 to 10% of lead and not more than 1.0% of phosphorus, the balance being copper.

B'. A copper-based alloy consists essentially of from 1 to 5% of manganese, from 0.3 to 2% of silicon and from 1 to 3% of tin, the balance being copper.

C'. A copper-based alloy consists essentially of from 1 to 5% of manganese, from 0.3 to 2% of silicon, from 2.5 to 10% of lead, from 1 to 3% of tin, and not more than 1.0% of phosphorus, the balance being copper.

D'. A copper-based alloy consists essentially of from 0.2 to 0.8% in total of at least one element selected from the IVb group and the VIb group of the periodic table, from 2.5 to 10% of lead, and not more than 1.0% of phosphorus, the balance being copper.

E'. A copper-based alloy consists essentially of from 0.2 to 0.8% in total of at least one element selected from the IVb group and the VIb group of the periodic table from 1 to 3% of tin, and not more than 1.0% of phosphorus, the balance being copper.

F'. A copper-based alloy consists essentially of from 0.2 to 0.8% in total of at least one element selected from the IVb group and the VIb group of the periodic table, from 2.5 to 10% of lead, from 1 to 3% of tin, and not more than 1.0% of phosphorus, the balance being copper.

G'. A copper-based alloy consists essentially of from 1 to 5% of manganese, from 0.3 to 2% of silicon, from 0.2 to 0.8% in total of at least one element selected from the IVb group and the VIb group of the periodic table, from 2.5 to 10% of lead, and not more than 1.0% of phosphorus, the balance being copper.

H'. A copper-based alloy consists essentially of from 1 to 5% of manganese, from 0.3 to 2% of silicon, from 0.2 to 0.8% in total of at least one element selected from the IVb group and the VIb group of the periodic table, from 0.2 to 0.8% of tin, and not more than 1.0% of phosphorus, the balance being copper.

I'. A copper-based alloy, consists essentially of from 1 to 5% of manganese, from 0.3 to 2% of silicon, from 0.2 to 0.8% in total of at least one element selected from the IVb group and the VIb group of the periodic table, from 2.5 to 10% of lead, less than 5% (not including zero%) of tin, and not more than 1.0% of phosphorous, the balance being copper.

There is no authentic designation in the chemical field for the A and B subgroups of the III, IV, V, VI and VII groups of the periodic table. The IVb and VIb sugroups used herein correspond to the designation, which is recited on page 277 of Concise Encyclopaedic Dictionary of METALLURGY (edited by D. Birchon and published by Elsevier), and which is adopted by Sinnott, in "The Solid State for Engineers (John Wiley and Sons. Inc., New York, 1958) and Richards, Engineering Material Science (Wadsworth Publishing Co. Inc., San Francisco; Chapman and Hall, London, 1961)". The IVb subgroup defined in the above-mentioned dictionary includes titanium, zirconium and hafnium, and the VIb subgroup includes chromium, molybdenum and tungsten.

In the present invention the copper-based alloy is strengthened to suppress the reduction of hardness at an elevated temperature as long as heat conductivity which is usually deteriorated by an alloying element is not reduced appreciably. As a result, shoes with an excellent sliding characteristic are obtained. The alloying elements according to the present invention can strengthen the copper-based alloy, while these elements do not essentially bring about harmful effects such as (1) the Cu matrix of the alloy being excessively hardened and embrittled with an increase of the elements in a solid solution, (2) the occurrence of a non-uniform precipitation of intermetallic compounds in the Cu matrix, and (3) heat conductivity of the alloy being undesirably reduced.

The Inventors carried out metallographic examination of the alloys according to the present invention and were thus able to clarify the typical structure of the alloys. The compositions of the alloying elements are explained in detail in connection with the metallographic structure of the alloys. The effects of the alloying elements on the properties required for the shoes of the swash-plate type compressor, as described below, are based on the study of metallographic structure mentioned above and the life tests of the shoes installed in the actual compressor.

In the A group alloys (i.e., the alloys mentioned in items A, B and C, above) and the A-B group alloys (i.e., the alloys mentioned in items G, H and I, above), the manganese and silicon are present in the alloys mainly as a solid solution of the alloys and the mechanical strength of the alloys is enhanced due to the solid solution hardening. The simultaneous addition of manganese and silicon to the copper-based alloys, however, leads to the formation of the Mn-Si compounds and the precipitation of a part of the manganese and silicon in the Cu matrix. Accordingly, an effective strengthening of the A group alloys and the A-B group alloys is promoted by both the solid-solution and the precipitation effects of manganese and silicon, and the wear resistance is improved in addition to the strengthening of the alloys. The content of silicon in the A and A-B group alloys should be from 0.1 to 4%, preferably from 0.3 to 2.0%, because a Si content of less than 0.1% is insufficient for causing the matrix of the alloys to be hardened by the solid solution of Si, while an Si content in excess of 4% may lead to the excessive precipitation of intermetallic compounds and thus embrittlement of the alloys. The content of manganese in the A and A-B group alloys of the present invention should be from 0.5 to 8%, preferably from 1 to 5%, and more preferably from 4 to 5%. The mechanical properties of the alloys can be enhanced by the addition of manganese alone due to the solid solution of manganese in the Cu matrix. However, when both manganese and silicon are added to the A and A-B group alloys, desirable eutectic Mn-silicides can be formed in the alloys and can also provide the alloys with excellent wear resistance. When, however, the Mn addition content is less than 0.5%, hypoeutectic silicides are formed and hence excellent wear resistance cannot be obtained. On the other hand, when the Mn addition content exceeds 8%, the hardness of the Cu matrix is so high that shoes made from the alloys mentioned above wear out the mating material. At the same time, heat conductivity of these alloys is excessively reduced.

The lead, which is added to the A group, B group and A-B group alloys with Pb or with Pb and Sn, is an element of a low melting point (less than 400° C.) and is not present as a solid solution but is dispersed in the Cu matrix. The addition of lead considerably enhances the sliding characteristics of the shoes with respect to the swash-plate. Namely, the soft Pb phases dispersed in the alloys mentioned above are readily deformed by the minute unevenness of the swash-plate surface, and also produce a surface upon which the swash-plate can smoothly slide. The lead addition, therefore, enhances the adaptability of the shoes to the swash-plate surface condition (hereinafter referred to as the break-in property) and to the smooth sliding motion of the swash plate. Accordingly, due to the lead addition, it is possible to more effectively mitigate the troublesome effects caused by the condition wherein lubricating oil is not present at the slidable engagement between the shoes and the swash plate during the initial operating period of the swash-plate type compressor than in the case of the Mn- and Si- addition only. The content of lead should be from 0.5 to 15% because a lead content of less than 0.5% is too low to obtain the above-mentioned break-in property. Furthermore, if the lead content exceeds 15%, it is difficult to distribute the lead uniformly in the copper-based alloy unless a special process for producing the copper-based alloy is used. Moreover, a Pb content exceeding 15% will disadvantageously reduce the strength of the Cu matrix.

At least one element selected from the IVb group and the VIb group of the periodic table is mainly precipitated in the Cu matrix for strengthening the A-B group alloy, above, while the manganese and silicon contents of these alloys are mainly present as a solid solution of the Cu matrix. In the A-B group alloys, the A group elements, (i.e., manganese and silicon) and the B group element(s) (i.e., element(s) selected from the IVb group and VIb group) are combined together for effectively hardening the copper-based alloys and for effectively improving the wear resistance of the alloys. In the IVb and VIb groups of the periodic table, titanium, zirconium, chromium, molybdenum and tungsten are usually used alone or in combination, and chromium, titanium and zirconium can be effectively used alone or in combination. The chromium induces the precipitation hardening of the B group and A-B group alloys and thus increases the strength of the B group and A-B group alloys. However, since these alloys are embrittled as a whole by an excessive amount of the chromium addition, the appropriate chromium content should not exceed 1%, i.e., the level at which the precipitation hardening of the B group and A-B group alloys takes place. The titanium precipitates in the matrix of the B group and A-B group alloys after heat treatment and also increases the hardness of the these alloys. The appropriate titanium content to be added to the B group and A-B group alloys is in an amount of 1% or less. Zirconium forms intermetallic compounds with several components of the B group and A-B group alloys and thereby strengthens these alloys. Such strengthening of alloys by adding the above-mentioned elements in combination to form intermetallic compounds is more effective than strengthening of alloys by adding such elements separately to form the intermetallic compounds, even when the content of the separate amount of element is equal to the content of the total amount of added elements.

When the Zr content exceeds 1%, heat conductivity of the copper-based alloy is abruptly reduced; accordingly, the Zr content should therefore be adjusted properly to an amount not exceeding 1%.

In the case where two or more elements selected from the IVb group and the VIb group of the periodic table are used, the total amount of such elements should not exceed 1% because embrittlement of the entire copper-based alloy is induced if the total amount of the elements used exceeds 1%. The minimum content of the IVb and VIb group element(s) should be approximately 0.1% (in total) for both cases of the single addition and the combined addition of such elements. A minor amount of the IVb and VIb group element(s) is effective for improving the mechanical strength of the B group and A-B group alloys. Therefore, the minimum content mentioned above is not absolutely crucial but preferable for obtaining a sufficient mechanical strength. When at least two elements of the IVb and VIb groups are used, their contents may be either the same or different. In the case where two elements are used, the minimum content of one element is approximately 0.05%; in the case where three elements are used, the minimum content of one element is approximately 0.03%.

Tin, which is added into the A group alloys with Sn, or with Pb and Sn, B group alloys with Sn, or with Pb and Sn, and A-B group alloys with Sn or with Pb and Sn, is present as a solid solution of the Cu matrix to harden the matrix. As a result of experiments, the tin was found to decrease and to advantageously stabilize the coefficient of friction even at elevated temperatures. The sliding engagement between the shoes and the swash plate was also found to exhibit an excellent resistance against seizure, particularly at elevated temperatures. Tin, which is present as a solution of the Cu matrix as stated above, is therefore liable to reduce the heat conductivity of the copper-based alloy. Consequently, the maximum Sn content should be 5%. The preferable Sn content is from 1 to 3%. Tin has also been found to improve the castability of the copper-based alloy.

The lead and/or tin is hereinafter referred to as the C group element(s).

Phosphorus, which is added to the copper-based alloy in addition to the elements of groups A and/or B, should be used in an amount not exceeding 1.5%, preferably 1%, thereby forming fine precipitation phases of phosphide in the Cu matrix. As a result, the copper-based alloy is effectively strengthened and its hardness is effectively prevented from being reduced at an elevated temperature. The phosphorus, however, reduces the heat conductivity of the copper-based alloy by an appreciable extent. Nevertheless, the advantageous effects of the phosphorus itself and the advantageous effects due to the combined use of the phosphorus with other additional elements can compensate for the disadvantage caused by such reduction in heat conductivity. Namely, the sliding characteristics produced especially under a high load are considerably improved due to the improved break-in property and sliding property of the shoes, because a high degree of hardness can be maintained at an elevated temperature due to the presence of phosphorus and, further, because the coefficient of friction of the copper-based alloy is decreased due to the presence of the C group element(s). The phosphide phases present in the Cu matrix help to capture lubricating oil on the surface of the shoes. As a result, an oil film on the surface of the shoes cannot be easily broken.

When the phosphorus content exceeds 1.5%, the alloy is excessively hardened as a whole and is thus embrittled and liable to crack, and the heat conductivity of the copper-based alloy is extremely decreased. As a result, fracture of the shoes is liable to occur. Therefore, a fragile copper-based alloy containing more than 1.5% of phosphorus cannot be suitably used for manufacturing shoes to which a high impacting load is applied, and the low heat conductivity of such alloys also causes the problem of poor heat radiation when shoes made of such alloy are used. Accordingly, the minimum phosphorus content should be 0.01% or 0.03%. Even a minor amount of phosphorus is effective for improving some but not all of the copper-based alloy properties. For example, a phosphorus addition ranging from approximately 0.01 to 0.03% improves the heat conductivity of the alloy because phosphorus deoxidizes the copper-based alloy. Seizure can therefore be prevented by deoxidization of the copper-based alloy. However, when a large amount of phosphorus is added to the alloy, the disadvantageous effect of such phosphorus on heat conductivity will be more prominent than its advantageous deoxidation effect. An addition of phosphorus can also improve the castability of the copper-based alloy. Since seizure can be prevented even by a small addition of phosphorus, it is difficult to define the absolute minimum content of the phosphorus. However, it has been found by the Inventors that a phosphorus content of at least 0.1% can bring about some degree of improvement in the sliding characteristic of the shoes.

The A-B group alloys, containing either lead or tin or both are preferable as materials for producing shoes which can be mounted in the highly-efficient swash-plate type compressor for air-conditioning vehicles using a small amount of the lubricating oil. Factors which are most critical to such swash-plate type compressor are heat conductivity of the shoes and the level of the coefficient of friction. A high coefficient of friction is a direct cause of heat generation on the surface of contact between the swash plate and the shoes, and furthermore, the major factors affecting the above-mentioned heat conductivity are the type and the amount of alloying elements. Accordingly, in order to mount the shoes in the highly efficient, swash-plate type compressor, the hardening and excellent break-in properties of the Cu matrix must be attained by maintaining the contents of the alloying elements to a level which is as low as possible. In more detail, both of these properties of the Cu matrix are required particularly during the initial period of operating the swash-plate type compressor. During the normal operation period, since a relatively small and insufficient amount of lubricating oil is supplied to the shoes, the sliding characteristics of the shoes are enhanced not by the improved break-in property of the Cu matrix but mainly by the increased heat conductivity of the shoes, thereby heat is effectively radiated from the shoes and, furthermore, reduction of the hardness of shoes at an elevated temperature, due to the structural change of the shoes, is suppressed.

As mentioned hereinbefore, tin (C group element), manganese and silicon (A group elements) contribute mainly to enhancing the sliding characteristics during the normal period of operation. On the other hand, the enhanced break-in property attained by the lead addition to the copper-based alloy is not highly effective during the normal operation period but only during the initial operation period of the swash-plate type compressor. During this initial period, hardly any lubricating oil is present between the swash plate and the shoes. The above-mentioned sliding condition may be mitigated during the initial operation period so that the oil-free lubricating condition is caused to disappear within a short period of time due to the design of the swash-plate type compressor. However, this condition cannot be caused to disappear completely. Moreover, this condition may sometimes occur even during the normal operation period, because the lubricating oil and the refrigerant gas may sometimes be decreased during this period. The shoes made of alloys containing Pb and Sn (the C group elements) can therefore be used under various sliding conditions wherein no seizure is caused to occur between the shoes and the swash plate.

All kinds of copper-based alloys according to the present invention explained hereinabove possess a Vickers hardness of 80 or higher at a temperature of 300° C. These copper-based alloys may contain a trace amount of nickel, iron, tellurium, antimony or arsenic as impurities or as additional elements. These elements are mainly advantageous for enhancing the strength of the copper-based alloys or for refining the grain size of the matrix of such alloys. However, the advantageous effects of these elements are inferior to those of manganese, silicon, lead and tin. Therefore, the additional elements mentioned above may be present only in a trace amount, if these elements are intentionally added to the alloys of the present invention.

Due to the compositions of the alloys according to the present invention, the following advantages can thereby be obtained. Namely, since the alloys of the present invention exhibit excellent characteristics of sliding and capturing lubricating oil at the surface of the shoes and, furthermore, since the content of the alloying elements used in the shoes of the present invention is considerably lower than the content of copper-based alloys used in conventional shoes, the shoes of the present invention have such an excellent heat conductivity, that a great amount of heat due to friction generated at the slidable engagement between the shoes and the swash plate is easily radiated from the shoes, even when this engagement is not substantially lubricated for a long period of time. As a result, the shoes cannot be easily softened due to the heat generated by friction, and seizure of the shoes is thereby prevented from occurring.

From the above-stated fact that the content of alloys according to the present invention is low, it would seem that the alloys according to the present invention would not be strong enough. On the other hand, although conventional, high strength brass and low Si-Mn bronze contain as high as 40% of alloying elements, such brass and bronze still have a poor heat radiation property. However, since the above-mentioned seizure easily occurs in these conventional copper-based alloys due to poor heat radiation thereof, attempts to prevent such seizure have been made by persons skilled in the art by adding a large amount of lead into these conventional, copper-based alloys, so as to enhance the break-in property and the sliding property of the alloys. The alloys to which lead has been added have a mechanical strength slightly superior to that of the present invention, in which lead and other alloying elements are low, only at room temperature and not at elevated temperatures. In the alloys of the present invention, since only a small amount of lead is used to enhance the break-in property, and further, since the elements present as a solid solution, i.e., manganese, silicon, tin and phosphorus, are added to the copper-based alloy, reduction in the strength and hardness of the matrix is slight, when the temperature of the shoes is elevated due to friction occurring between the shoes and the swash plate. Therefore, the highly stable state of the matrix of the alloys according to the present invention contributes to effectively enhance the break-in property due to the Pb phases which are finely dispersed in this matrix. The copper-based alloy according to the present invention may be solution treated at a temperature of from 400° to 800° C.

The present invention is explained in detail with reference to the drawings, wherein.

Figure 1:
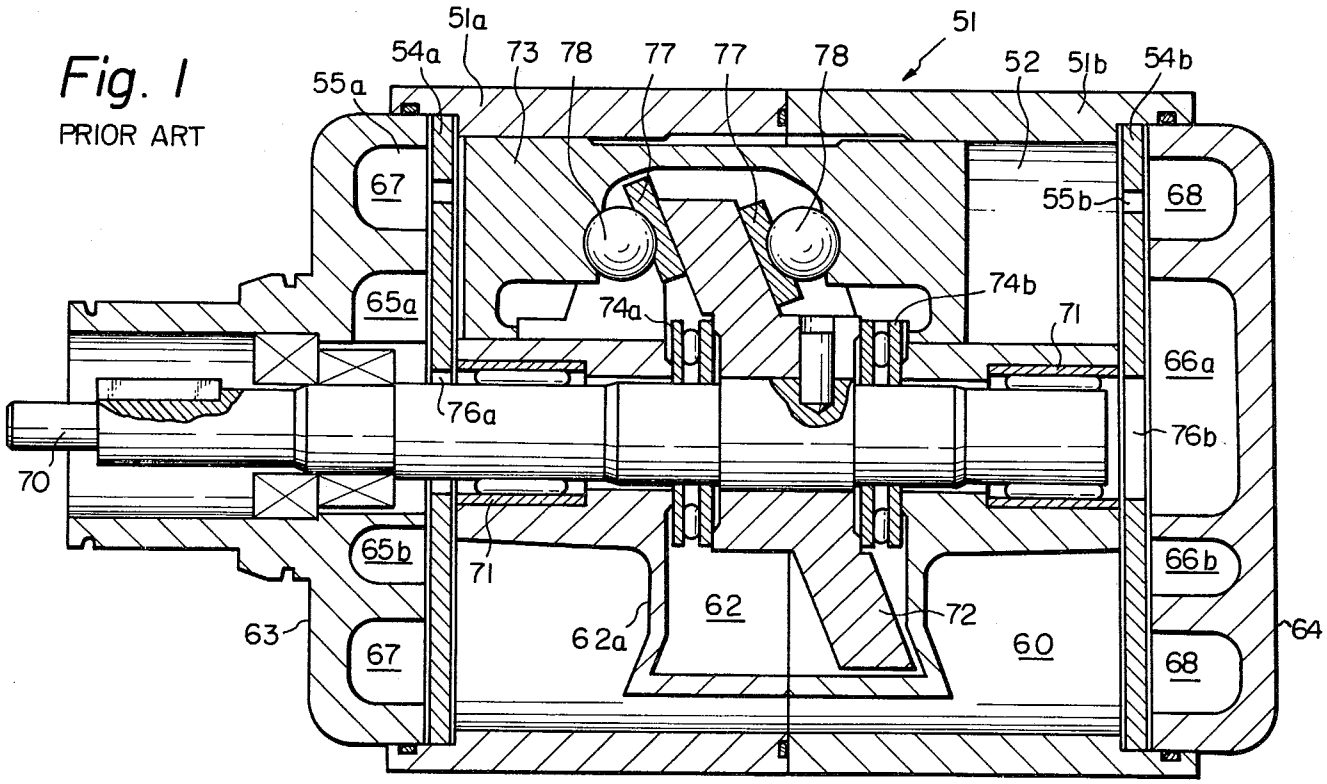
Fig. 1 PRIOR ART
FIG. 1 is a longitudinal cross-sectional view of a swash-plate type compressor according to one embodiment of the present invention.

Referring to FIG. 1, the compressor has a pair of cylinder blocks, i.e., a front cylinder block 51*a* and a rear cylinder block 51*b*, combined with each other in axial alignment. The combined block formed by the pair of cylinder blocks 51*a* and 51*b* is provided with at least one, usually three, axially extending cylinder bores 52 arranged in parallel with each other. The combined block is also provided with a bottom oil reserve section 60, and a centrally arranged swash-plate chamber 62. The combined block is further accompanied by a pair of front and rear cylinder heads 63 and 64 attached to the front and rear cylinder blocks 51*a* and 51*b*, respectively, via respective valve plates 54*a* and 54*b* and appropriate gaskets. The cylinder heads 63 and 64 are provided with, in their internal spaces, suction chambers 65 and 66 and exhaust chambers 67 and 68, respectively. A drive shaft 70 coaxially passes through both cylinder blocks 51*a* and 51*b*, front cylinder head 63, and front valve plate 54*a*. The drive shaft 70 is rotatably supported by needle bearings 71 provided at axially outer ends of the combined block. In addition, the drive shaft 70 is provided with a swash plate 72 secured to the middle thereof. The swash plate 72 is operatively connected via ball bearings 78 and shoes 77 with double acting multi-pistons 73 which are slidably fitted in the cylinder bores 52 arranged in parallel with the drive shaft 70. Therefore, when the swash plate 72 is rotated by the drive shaft 70, the pistons reciprocate in the cylinder bores for effecting the compression action of the compressor. The axial loads produced by the reciprocating motions of the pistons 73 are borne by a pair of thrust bearings 74*a* and 74*b* arranged between both end faces of the boss of the swash plate 72 ad respective cylinder blocks 51*a* and 51*b*. The needle bearings 71 are supplied with oil lubricant through bores 76*a* and 76*b* of the valve plates 54*a* and 54*b*.

The partition walls 62*a* of the swash plate chamber 62 are provided with through-holes (not shown) for permitting a part of the oil particles suspended in the refrigerant gas to directly flow into the swash plate chamber 62. The refrigerant gas is collected in the discharge sections (not shown) of the cylinder blocks 51*a* and 51*b* from the exhaust chambers 67, 68 of both cylinder heads 63 and 64, so as to flow into the air-conditioning system of the vehicle. The partition wall 62*a* is provided with outlet holes (not shown) through which the refrigerant gas and the oil particles in the swash plate chamber 62 can flow into the oil reserving section 60. During the operation of the compressor, the refrigerant gas together with the oil particles suspended in the gas, return from the air-conditioning system of the vehicle and rush into the suction channels (not shown) of cylinder blocks 51*a* and 51*b*. The major part of the refrigerant gas and oil particles then impinge upon the partition wall 62*a* of the swash plate chamber 62. In the meantime, the remaining minor part of the refrigernt gas and oil particles flows into the swash plate chamber 62 through the through-holes (not shown) of the partition walls 62*a*, and the flow of the minor part impinges upon the rotating swash plate 72, so that the oil particles suspended in the refrigerant gas attach to or are splashed by the rotating swash plate.

Elements of the compressor except for the above-mentioned shoes as shown in FIG. 1 basically have the same function and corresponding relationship as those disclosed in U.S. Pat. No. 3,955,899 issued to S. Nakayama, i.e., one of the present Inventors.

In accordance with the present invention, the shoes 77 made of the A group alloys, A-B group alloys or C group alloys and ball bearings 78 operatively connect the swash plate 72 with the pistons 73. As a result, the rotating motion of the drive shaft 70 is converted to the reciprocating motion of the pistons 73. In the bores 52, the reciprocating motion compresses the refrigerant gas which is mixed with oil so as to be circulated in a refrigeration circuit and returned to the compressor, and thereafter transfers the refrigerant gas to the condensor (not shown). The refrigerant gas is cooled in the condensor to be liquefied, and then transferred to the evaporator, thereby the liquefied refrigerant gas is vaporized and latent heat of vaporization is thus removed from the vicinity of the evaporator. The air in the driver's room is therefore cooled, while the heat withdrawn from the air is emitted to ambient during the movement of the refrigerant gas through the condensor mentioned above.

The shoes 77 according to the present invention can reliably be used under severe sliding condition, in which the swash plate 72 slides with respect to the shoes 77 at a variable speed (V) ranging from approximately 2 to 3 m/sec. during the idling period of the vehicle engine and also at a speed ranging from 20 to 25 m/sec. during maximum rotation, i.e., 6000 rpm of the engine, and even as high as from approximately 7 to 15 m/sec during normal travel. In addition, the shoes according to the present invention can be reliably used for a long period of time under a load as described below. The load is applied to the shoes 77 and thereby causes the piston to compress the refrigerant gas. Such load is varied within a magnitude (P) range of from 60 to 130 kg/cm$^2$, or occasionally up to 140 kg/cm$^2$. The product of P and V mentioned above can frequently exceed 2000 but rarely amount to a value corresponding to the product of maximum P and maximum V. The P-V product is varied repeatedly with the change in the number of rotations of the vehicle engine. Because of the P-V product variance, the load applied to the shoes is impact-like particularly at a high engine rotation.

The shoes 77 according to the present invention can be effectively used in the compressor, when the amount of lubricating oil, which is inversely proportional to the refrigerating capacity, is decreased. As a result, a severe lubricating condition is created at the surface between the shoes 77 and the swash plate 72. The shoes 77 according to the present invention are particularly suited for the compressor, which must be operated under boundary lubrication conditions because the swash plate 72 and the shoes 77 and frequently kept in a thrust sliding engagement. This engagement is unavoidable during the initial period of the compressor operation, when, as frequently encountered in vehicle operation, the refrigerant gas is leaked from the conduits of the refrigerant circuit and the amount of refrigerant in the circuit is thus decreased, and also when the amount of refrigerant gas returned to the compressor is decreased by energizing an apparatus fitted on the evaporator for adjusting the vaporizing pressure.

The shoes according to the present invention can be used with a swash plate 72 made from any conventional material.

For an extremely severe sliding condition an alloyed steel such as the chromium steel and the manganese steel should be appropriately selected for the swash plate 72. The nodular graphite cast iron, which exhibits inferior sliding when used against a shoe material other than that of the present invention, can be reliably used in combination with the copper-based alloys of the present invention.

Although an embodiment of the present invention is explained with reference to U.S. Pat. No. 3,955,899, the shoes according to the present invention can also be mounted in the swash-plate type compressor disclosed in U.S. Pat. Nos. 3,750,848 and 3,801,227 issued to Nakayama.

The present invention is explained in further detail by way of the following Example.

EXAMPLE

Alloying elements were added to a copper melt at a temperature of approximately 1250° C. in the sequence of manganese, silicon, tin, chromium, zirconium, titanium, phosphorus and lead. The obtained ingots of copper alloy materials were heat-treated at approximately 700° C. for two hours so as to prevent segregation therein. The ingots were each drawn to a round bar of 18 mm in diameter and then, cut to a thickness of 4.5 mm. Formed on one side of the discs is a spherical recess with a depth of approximately 3 mm, into which a portion of a steel ball of a diameter of 14 mm is to be engaged.

The chemical compositions of the copper alloy materials are shown in Table I, below.

TABLE I

| Sample No. | Mn (%) | Si (%) | Cr (%) | Zr (%) | Ti (%) | Pb (%) | Sn (%) | P (%) |
|---|---|---|---|---|---|---|---|---|
| 1 | 1.0 | 0.7 | 0.3 | — | — | 2.0 | — | 0.2 |
| 2 | 3.0 | 1.0 | — | — | 0.5 | 5.0 | — | 0.5 |
| 3 | 3.0 | 1.0 | — | 0.5 | — | 8.0 | — | 0.7 |
| 4 | 1.0 | 0.7 | 0.2 | 0.2 | 0.2 | 5.0 | — | 0.1 |
| 5 | 3.0 | 1.0 | — | — | 0.5 | — | 2.0 | 0.5 |
| 6 | 1.0 | 0.5 | 0.2 | 0.2 | 0.2 | 2.0 | 4.0 | 0.2 |
| 7 | 3.0 | 1.0 | — | — | 0.5 | 5.0 | 2.0 | 0.3 |
| 8 | 5.0 | 1.5 | 0.5 | — | — | 7.0 | 1.0 | 0.3 |
| 9 | — | — | 0.5 | — | 0.5 | 5.0 | — | 0.3 |
| 10 | — | — | 0.3 | 0.3 | 0.3 | — | 2.0 | 0.3 |

TABLE I-continued

| Sample No. | Mn (%) | Si (%) | Cr (%) | Zr (%) | Ti (%) | Pb (%) | Sn (%) | P (%) |
|---|---|---|---|---|---|---|---|---|
| 11 | — | — | 0.5 | — | 0.5 | 6.0 | 2.0 | 0.5 |

In the table, above, the balance of the alloying elements was copper.

For comparison purposes, the discs in the form of shoes were produced from conventional alloy materials as shown in Table II, below, by using the same procedure as that of the producing shoes according to the present invention.

TABLE II

| Sample No. | Resignation | Alloy Composition |
|---|---|---|
| 12 | Control 1 | Cu-3%Mn-1%Si-0.5%Ti-5%Pb |
| 13 | Control 2 | Cu-3%Mn-1%Si-0.5%Ti-5%Pb-2%Sn |
| 14 | Control 3 | Cu-3%Mn-1%Si-0.2%Cr-2%Sn |
| 15 | Phosphorus Bronze | Cu-8%Sn-0.4%P |
| 16 | Alusil alloy | Al-20%Si |
| 17 | Babbitt metal | Pb-10%Sn-5%Sb-2%Cu |
| 18 | High Strength Brass | Cu-35%Zn-2%Al-1%Si-2.5%Mn-2%Pb |
| 19 | Cu—Pb—Sn sintered alloy | Cu-24%Pb-3.5%Sn |
| 20 | Low Si—Mn bronze | Cu-35%Zn-2%Al-1%Si-2.5%Mn |
| 21 | Al Bronze | Cu-8%Al-3%Fe-1%Mn-1%Ni |
| 22 | Pure copper | 100%Cu |

Samples Nos. 12 through 14 correspond to the copper-based alloys described in the other U.S. patent application Ser. No. 960,772 filed Nov. 15, 1978 filed by the present inventors.

The shoes produced from the alloy samples Nos. 1 through 11 had a hardness of more than Hv100 at room temperature.

EXPERIMENT 1

Shoes made from the alloy samples shown in Tables I and II were tested to measure the coefficient of friction and heat generation during this measurement. In this test, while each of the shoes was pressed against a rotating disc as the pressure load was gradually increased, the coefficient of friction and the temperature increase of the shoes were measured. The testing conditions used are described as follows.

1. Sliding speed:
   13 m/second (constant)
2. Load:
   increased from 40 Kg/cm$^2$ by 20 Kg/cm$^2$ at every loading stage. The period of each loading stage lasted 30 minutes.
3. Lubricating oil:
   low viscosity oil SSU (Saybolt Universal Second) 70 seconds.
4. Application of lubricating oil:
   the oil was applied by a felt on the disc at a rate of approximately 0.8 cc/minute.
5. Test specimens
   (a) Disc: straightness, 1 μm or less; and surface roughness (maximum), from 0.4 to 0.6-S.
   (b) Shoes: straightness, 1 μm or less; and surface roughness (maximum), from 0.4 to 0.6-S.

Figure 2:
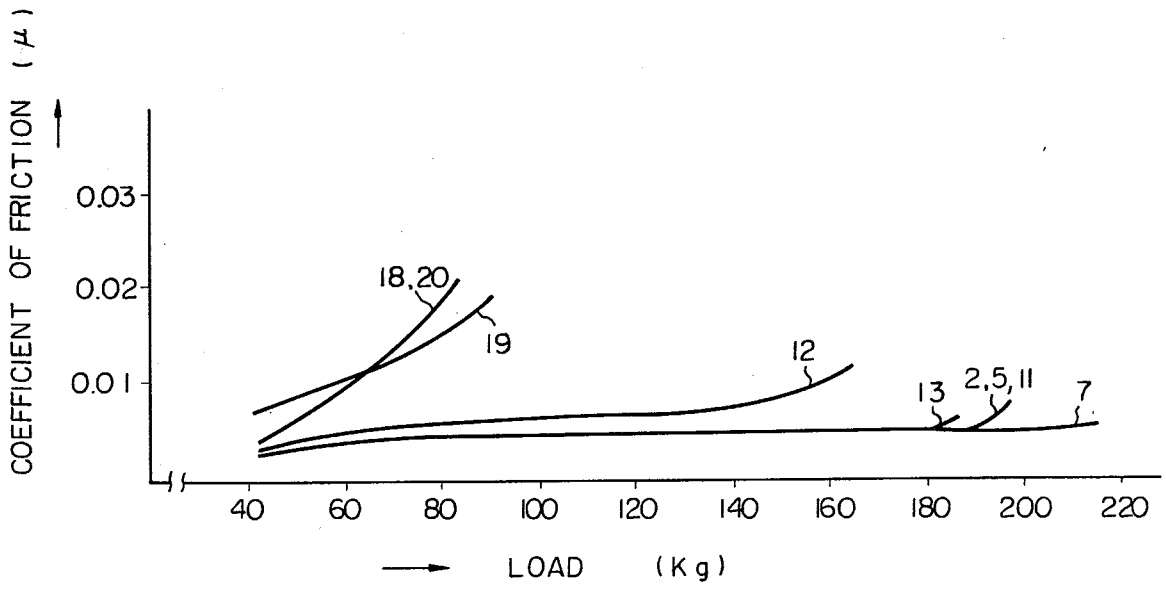
FIG. 2 is a graph representing the coefficient of friction obtained in the Example of the present invention.
Figure 3:
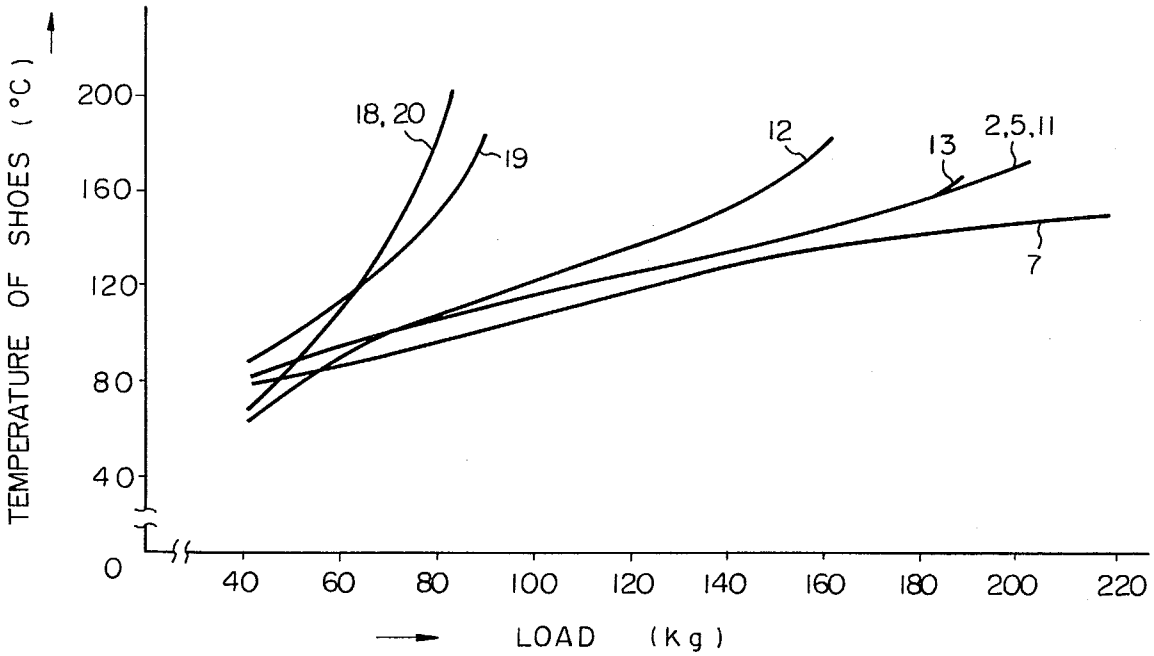
FIG. 3 is a graph representing the temperature increase of the shoes obtained in the Example of the present invention.

The test results of several alloy samples are shown in FIGS. 2 and 3. The test results of the other alloy samples Nos. 1, 3, 4, 6 and 8 according to the present invention were slightly inferior to but substantially the same as those of samples Nos. 2, 5, 7 and 11 shown in FIGS. 2 and 3. As seen in FIG. 2, the coefficient of friction according to the alloy samples of the invention is lower than that of the control alloy samples Nos. 18 through 20 for a broad range of load values. With increasing load, the coefficient of friction remains stable, i.e., less than 0.01 at a load of 140 Kg (70 Kg/cm$^2$). In addition, as seen from the temperature increase illustrated in FIG. 3, the temperature increase of the shoes according to the present invention is lower than that of the control samples particularly at the range of high load values. From the results shown in FIGS. 2 and 3, the following conclusion can be drawn.

Since an increase in load always increases the coefficient of friction of the shoes and thus leads to heat generation on the surface of the shoes, the swash plate is liable to be seized by shoes, such as those made from the alloy samples Nos. 18, 19 and 20, exhibiting an inferior heat conductivity due to the increase of the friction coefficient and also due to a change in the structure of the shoes. However, the alloy samples of the present invention have an excellent, sliding characteristic mentioned above, so that the temperature of each entire shoe or the temperature of a region of the shoes close to the sliding surface is not elevated to a considerable level. Accordingly, phenomena such as structural changes or increases of the friction coefficient do not substantially occur with regard to the alloy samples of the present invention, and these alloys are therefore stable over a wide range of load values. It is to be noted that mainly because of conditions 1 through 3 of Experiment 1 and also because of condition 4 of Experiment 1, mentioned above, the oil lubrication used in Experiment 1 was not enough. The test results of samples according to the invention, however, were excellent under such conditions.

EXPERIMENT 2

Every kind of shoe produced in the above-mentioned Example was tested in the actual compressor under the most severe lubricating conditions. Such test conditions are described as follows.

1. Compressor:
   a swash-plate type compressor with a total displacement of 150 cc
2. Number of rotations:
   4000 rpm
3. Gas pressure at the exhaust side:
   Pd=4–5 Kg/cm$^2$
4. Gas pressure at the suction side:
   Ps=approximately −50 L mmHg
5. Operation time:
   20 hours
6. Lubricating oil:
   from 110 to 150 cc of an ice machine oil
7. Mating material:
   nodular cast iron
8. Amount of refrigerant gas:
   100 g (approximately 10% of normal amount)

The results of the test are summarized in the following table.

TABLE III

| Sample No. | Amount of Oil 150cc | 140cc | 130cc | 120cc | 110cc |
|---|---|---|---|---|---|
| (Invention) 2 | O | O | Δ | X | |
| (Invention) 5 | O | O | Δ | X | |

TABLE III-continued

| Sample No. | Amount of Oil | | | | |
|---|---|---|---|---|---|
| | 150cc | 140cc | 130cc | 120cc | 110cc |
| (Invention) 7 | O | O | O | Δ | X |
| (Control) 13 | O | Δ | X | | |
| (Control) 15 | X | | | | |
| (Control) 18 | X | | | | |

Note:
O : no seizure
Δ : Seijure occurred on several of the shoes
X : Seizure occurred on every shoe As is apparent from Table III, the occurrence of seizure can be effectively prevented in the samples of the present invention. Seizure of the samples of the present invention does not occur until the lubricating oil is reduced to a level lower than the level at which seizure of the control samples occurs.

It should be noted that shoes made according to the present invention were found to satisfactorily resist against sliding, which condition is more severe than that occurring during usual operation of vehicles.

EXPERIMENT 3

As in Example 1, five shoes made from each alloy sample were tested to determine the loads at which seizure occurred. Homogeneity of the quality of the shoes was evaluated from the dispersion of the values of the determined seizure loads.

Figure 4:
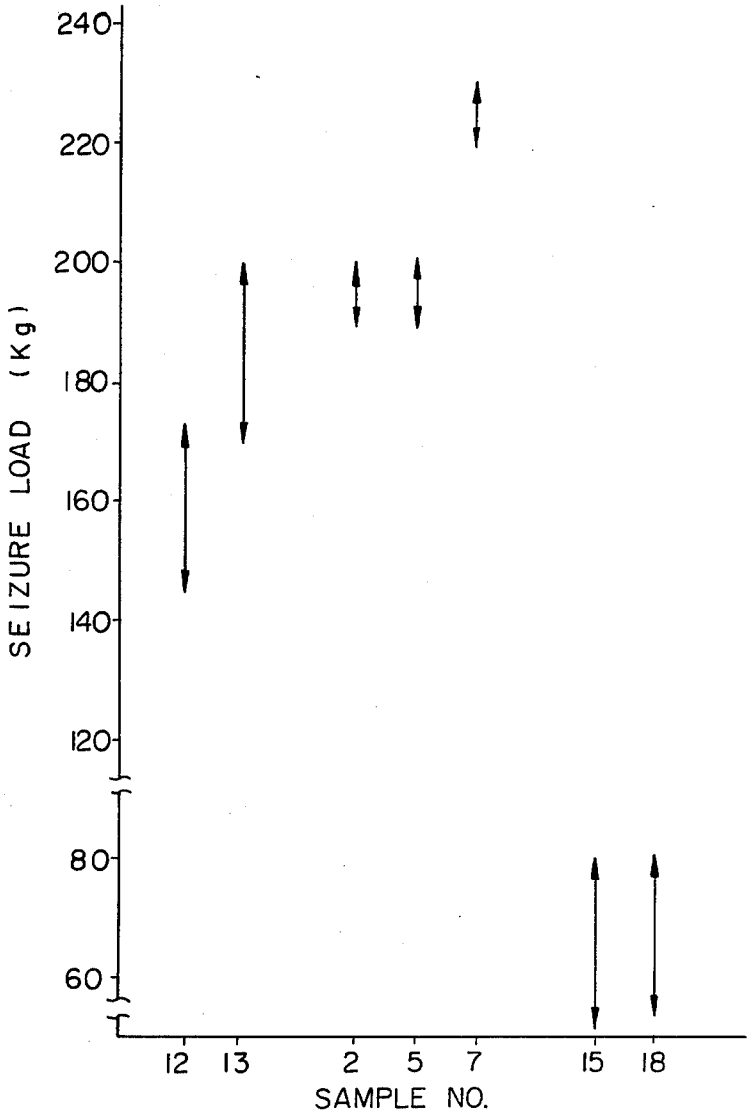
FIG. 4 is a graph representing a load at which the swash plate caused a seizure with the shoes produced in the Example of the present invention.

The results of the experiment are shown in FIG. 4. As is apparent from FIG. 4, the seizure loads of the alloy samples Nos. 2, 5 and 7 according to the present invention exhibit a small dispersion of the seizure load values; therefore, the quality of these alloy samples is considerably uniform. In addition, according to FIG. 4, the resistance of the shoes against seizure is also considerably increased in the present invention.

What we claim is:

1. A swash plate type compressor for air-conditioning vehicles, wherein a lubricating oil is supplied in said compressor in the state of a gaseous mixture with a refrigerant gas, said compressor comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, wherein said shoes are made of a copper-based alloy comprising from 0.5 to 8% of manganese, from 0.1 to 4% of silicon, from 0.5 to 15% of lead and from 0.1 to 1.5% of phosphorus, the balance being copper.

2. A swash-plate type compressor for air-conditioning vehicles, wherein a lubricating oil is supplied in said compressor in the state of a gaseous mixture with a refrigerant gas, said compressor comprising a cylinder block, a swash plate rotatably mounted in said cylinder block and supported by a rotating drive shaft, at least one piston slidably retained within said cylinder block and shoes mounted on said swash plate and retained by ball bearings, said ball bearings being operatively connected with said piston, wherein said swash plate reciprocates, by its rotation, at least one piston via said shoes and ball bearings, wherein said shoes are made of a copper-based alloy comprising from 0.5 to 8% of manganese, from 0.1 to 4% of silicon, from 0.5 to 15% of lead, less than 5% but more than 0% of tin, and not more than 1.5% of phosphorus, the balance being copper.

3. A swash-plate type compressor for air-conditioning of vehicles, wherein a lubricating oil is supplied in said compressor in the state of a gaseous mixture with a refrigerant gas, said compressor comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings wherein said shoes are made of a copper-based alloy comprising from 0.5 to 8% of manganese, from 0.1 to 4% of silicon, not more than 1% in total of at least one element selected from the IVb group and the VIb group of the periodic table, from 0.5 to 15% of lead, and not more than 1.5% of phosphorus, the balance being copper.

4. A swash-plate type compressor for air-conditioning of vehicles, wherein a lubricating oil is supplied in said compressor in the state of a gaseous mixture with a refrigerant gas, said compressor comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, wherein said shoes are made of a copper-based alloy comprising from 0.5 to 8% of manganese, from 0.1 to 4% of silicon, not more than 1% in total of at least one element selected from the IVb group and the VIb group of the periodic table, from 0.5 to 15% of lead, less than 5% but more than 0% of tin, and not more than 1.5% of phosphorus, the balance being copper.

5. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, wherein said shoes are made of a copper-based alloy comprising not more than 1% but more than 0% of molybdenum, from 0.5 to 15% of lead, less than 5% but more than 0% of tin, and not more than 1.5% of phosphorus, the balance being copper.

6. A swash-plate type compressor according to claims 1, 2, 3, or 4 wherein the content of silicon is from 0.3 to 2.0%, and the content of manganese ranges from 1 to 5%.

7. A swash-plate type compressor according to claim 6, wherein the concentration of manganese ranges from 4 to 5%.

8. A swash-plate type compressor according to claim 3, or 4 or 5, wherein the content of tin ranges from 1 to 3%.

9. A swash-plate type compressor according to claim 3 or 4, wherein the content of said at least one element selected from the IVb group and VIb group of the periodic table ranges from 0.2 to 0.8%.

10. A swash-plate type compressor according to claim 3 or 4, wherein said at least one element selected from the IVb group and VIb group of the periodic table is chromium.

11. A swash-plate type compressor according to claim 3 or 4, wherein said at least one element selected from the IVb group and VIb group of the periodic table is titanium.

12. A swash-plate type compressor according to claim 3 or 4, wherein said at least one element selected from the IVb group and VIb group of the periodic table is zirconium.

13. A swash-plate type compressor according to claim 3 or 4 wherein two additional elements are selected from the group consisting of chromium, titanium and zirconium.

14. A swash-plate type compressor according to claim 3 or 4, wherein the elements selected from the IVb group and the VIb group of the periodic table are chromium, titanium and zirconium.

15. A swash-plate type compressor according to claim 3 or 4, wherein the content of phosphorus is not more than 1.0%.

16. A swash-plate type compressor according to claim 15, wherein the concentration of phosphorus is not less than 0.01%.

17. A swash-plate type compressor according to claim 3 or 4 wherein said swash plate consists of an alloyed steel.

18. A swash-plate type compressor according to claim 3 or 4 wherein said swash plate consists of a nodular graphite cast iron.

19. A swash-plate type compressor according to claim 3 or 4, wherein a lubricating oil is supplied in said compressor in the state of a gaseous mixture with a refrigerant gas, alternating, sliding and thrust pressures ranging from 60 to 140 kg/cm$^2$ are applied to said shoes and said swash plate slides with respect to said shoes at a variable speed ranging from 2 to 25 m/second, and said copper-based alloy has a hardness of Hv 80 or more at a temperature of 300° C.

20. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings wherein said shoes are made of a copper-based alloy comprising from 0.5 to 8% of manganese, from 0.1 to 4% of silicon, not more than 1% but more than 0% of molybdenum, from 0.5 to 15% of lead, and not more than 1.5% of phosphorus, the balance being copper.

21. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, wherein said shoes are made of a copper-based alloy comprising from 0.5 to 8% of manganese, from 0.1 to 4% of silicon, not more than 1% but more than 0% of molybdenum, from 0.5 to 15% of lead, less than 5% but more than 0% of tin, and not more than 1.5% of phosphorus, the balance being copper.

22. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, wherein said shoes are made of a copper-based alloy comprising not more than 1% but more than 0% of tungsten, from 0.5 to 15% of lead, less than 5% but more than 0% of tin, and not more than 1.5% of phosphorus, the balance being copper.

23. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings wherein said shoes are made of a copper-based alloy comprising from 0.5 to 8% of manganese, from 0.1 to 4% of silicon, not more than 1% but more than 0% of tungsten, from 0.5 to 15% of lead, and not more than 1.5% of phosphorus, the balance being copper.

24. A swash-plate type compressor, comprising a cylinder block, a swash plate rotatably mounted in said cylinder block and supported by a rotating drive shaft, at least one piston slidably retained within said cylinder block, and shoes mounted on said swash plate and retained by ball bearings, said ball bearings being operatively connected with said piston, wherein said swash plate reciprocates, by its rotation, at least one piston via said shoes and ball bearings, wherein said shoes are made of a copper-based alloy comprising from 0.5 to 8% of manganese, from 0.1 to 4% of silicon, not more than 1% but more than 0% of tungsten, from 0.5 to 15% of lead, less than 5% but more than 0% of tin, and not more than 1.5% of phosphorus, the balance being copper.

* * * * *

UNITED STATES PATENT AND TRADEMARK OFFICE

CERTIFICATE OF CORRECTION

PATENT NO. : 4,244,679

DATED : January 13, 1981

INVENTOR(S) : Shozo Nakayama, et al

It is certified that error appears in the above—identified patent and that said Letters Patent is hereby corrected as shown below:

Column 4, line 67: "sugroups" should be --subgroups--.

Table III, footnote, second line: "seijure" should be --seizure--.

Signed and Sealed this

*Fourth* Day of *August 1981*

[SEAL]

*Attest:*

GERALD J. MOSSINGHOFF

*Attesting Officer*

*Commissioner of Patents and Trademarks*